US009022958B2

(12) United States Patent
Shimizu et al.

(10) Patent No.: US 9,022,958 B2
(45) Date of Patent: May 5, 2015

(54) WALKING ASSISTANCE DEVICE

(75) Inventors: Hideo Shimizu, Wako (JP); Hideaki Takahashi, Wako (JP); Koji Okazaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 423 days.

(21) Appl. No.: 13/488,880

(22) Filed: Jun. 5, 2012

(65) Prior Publication Data

US 2012/0316476 A1 Dec. 13, 2012

(30) Foreign Application Priority Data

Jun. 10, 2011 (JP) ..... 2011-129952
Jun. 15, 2011 (JP) ..... 2011-133600

(51) Int. Cl.
*A61H 3/00* (2006.01)
*A61H 1/02* (2006.01)

(52) U.S. Cl.
CPC ..... *A61H 1/0244* (2013.01); *A61H 3/00* (2013.01); *A61H 2201/1215* (2013.01); *A61H 2201/163* (2013.01); *A61H 2201/1642* (2013.01); *A61H 2201/165* (2013.01); *A61H 2201/1673* (2013.01); *A61H 2201/5002* (2013.01); *A61H 2201/5069* (2013.01)

(58) Field of Classification Search
CPC ..... A61H 1/0244; A61H 3/00
USPC ..... 601/5, 24, 33, 34, 35; 602/5, 16, 23
See application file for complete search history.

(56) References Cited

U.S. PATENT DOCUMENTS 8,313,448 B2 * 11/2012 Shimada et al. ..... 601/5
8,603,016 B2 * 12/2013 Shimizu et al. ..... 601/35
2011/0172570 A1 * 7/2011 Shimizu et al. ..... 601/35

FOREIGN PATENT DOCUMENTS

| | | |
|---|---|---|
| JP | S63-94847 U | 6/1988 |
| JP | 11-508167 | 7/1999 |
| JP | 2005-000634 A | 1/2005 |
| JP | 2006-320349 | 11/2006 |
| JP | 2006-320350 | 11/2006 |
| JP | 2006-320351 | 11/2006 |
| JP | 2007-152035 | 6/2007 |
| JP | 2009-095645 | 5/2009 |
| JP | 2010-000205 A | 1/2010 |
| JP | 2010-110464 | 5/2010 |
| JP | 2013-016449 | 1/2013 |

* cited by examiner

*Primary Examiner* — Quang D Thanh
(74) *Attorney, Agent, or Firm* — Rankin, Hill & Clark LLP

(57) ABSTRACT

In a walking assistance device (10) that can transmit the power generated by a power generator (26, 28) to a femoral part of a user, a swing arm (60, 62) is attached to an output member of the power generator at a base end thereof, and is connected to a femoral support plate (68, 70) at a free end thereof via a pivot joint (64). The pivot joint includes a spherical projection (100) provided on the free end of the swing arm and a socket (112) provided on the femoral support plate, the socket defining a spherical recess (110) configured to receive the spherical projection to permit a tilting movement of the femoral support plate at least in two directions with respect to the free end of the swing arm. Thereby, the femoral support plate is enabled to accommodate the build and/or the movement of the femoral part of the user.

8 Claims, 12 Drawing Sheets

WALKING ASSISTANCE DEVICE

TECHNICAL FIELD

The present invention relates to a walking assistance device that is configured to be worn by a user and provide a walking assistance force to the lower limb of the user.

BACKGROUND OF THE INVENTION

Previously proposed walking assistance devices include a power generator such as an electric motor to apply a walking assistance force to a lower limb of a user for the purposes of assisting the walking movement of the user and/or rehabilitating the walking impairment of the user. See JP2006-320349A, JP2006-320350A, JP2007-152035A and JP2006-320351A.

The walking assistance device typically includes a pelvic frame (main frame) configured to be worn on a pelvic part of a user and provided with the shape of letter C as seen from above, an abdominal belt that secures the pelvic frame on the pelvic part of the user, a pair of power generators mounted on either side part of the pelvic frame at positions corresponding to the hip joints of the user and a pair of femoral support members that transmit the power generated by the power generator to the femoral parts of the user.

The femoral support member proposed in JP2009-95645A includes a swing arm made of an elongated, stiff plate member having a base end connected to the output end of the power generator and a free end extending to a front face of the femoral part of the user slightly above the knee of the user, and a femoral belt having a first end connected to the free end of the swing arm and a second end connected to a point intermediate between the base end of the swing arm and the free end thereof to be passed around the femoral part of the user.

The femoral support member is required to be able to transmit the force of the power generator to the femoral part of the user without causing discomfort or pain to the user.

The pelvic frame is required to support the reaction force of the power generator without causing discomfort to the user.

Also, the pelvic frame and the abdominal belt are required to be easily worn by the user and removed from the user without detracting from the capability of the pelvic frame and the abdominal belt to be worn by the user in a stable and comfortable manner.

BRIEF SUMMARY OF THE INVENTION

Based on such a recognition by the inventors and with the aim of improving the performance of the conventional walking assistance devices, a primary object of the present invention is to provide a walking assistance device that can transmit the power generated by a power generator to a femoral part of a user in a reliable manner while minimizing the discomfort to the user.

A second object of the present invention is to provide a walking assistance device that can be worn and removed with ease while ensuring the capability of the walking assistance device to support the reaction of the power generator in a reliable manner and without causing discomfort to the user.

Such objects of the present invention can be accomplished by providing a walking assistance device, comprising: a pelvic frame having an intermediate portion configured to be applied to a lower back of a user and a pair of front portions extending laterally outward and forward from the intermediate portion; an abdominal belt detachably securing the pelvic frame on a pelvic part of the user; a power generator attached to each front portion of the pelvic frame at a position corresponding to a hip joint of the user; a swing arm having a base end connected to an output end of each power generator; and a femoral support member connected to a free end of the swing arm via a pivot joint and configured to be applied to a femoral part of the user; wherein the pivot joint includes a spherical projection provided on one of the free end of the swing arm and the femoral support member and a socket provided on the other of the free end of the swing arm and the femoral support member, the socket defining a spherical recess configured to receive the spherical projection to permit a tilting movement of the femoral support member at least in two directions with respect to the free end of the swing arm.

Because the femoral support member is attached to the free end of the swing arm via the pivot joint, the femoral support member is enabled to tilt in any direction so that the femoral support member can favorably conform to the build of the user and/or the movement of the femoral part of the user. Thereby, the force of the power generator is effectively transmitted to the femoral part of the user while ensuring a favorable fit and hence a comfort to the user.

Preferably, the femoral support member includes a front femoral support plate configured to be applied to a front part of the femoral part of the user and a femoral belt configured to be detachably passed around the femoral part of the user and engaged by either side part of the femoral support plate at two ends thereof According to a preferred embodiment of the present invention, the spherical projection is provided with a pair of flat surfaces on either side thereof substantially in parallel to each other, and the spherical recess is provided with an open end including a narrower side limited by a pair of parallel edges, a width between the two parallel edges being smaller than a nominal outer diameter of the spherical projection and being equal to or greater than a width between the two flat surfaces.

Therefore, by orienting the flat surfaces of the spherical projection in parallel with the parallel edges that define the narrower side of the opening, the spherical projection can be fitted into the spherical recess. After the spherical projection is received in the spherical recess, the spherical projection is turned by 90 degrees around the axial line directed in the projecting direction of the spherical projection. As the width between the two parallel edges is smaller than a nominal outer diameter of the spherical projection, the spherical projection is thereby retained within the spherical recess. Therefore, the femoral support member can be attached and detached to and from the free end of the swing arm in both easy and reliable manner.

To facilitate the insertion of the spherical projection into the spherical recess, the width between the flat surfaces of the spherical projection may be narrower at a free end of the spherical projection than at a base end thereof.

According to a preferred embodiment of the present invention, the socket includes a plurality of discrete surface pieces defining an inner surface of the spherical recess, the discrete surface pieces including a bottom surface piece and a pair of side surface pieces, each side surface piece including an overhang such that the side surface pieces jointly define an open end of the spherical recess narrower than the nominal outer diameter of the spherical projection but equal to or wider than the width between the flat surfaces of the spherical projection.

Thereby, the socket may be molded by plastic material. In particular, if the socket is provided with a pair of through holes on either side of the bottom surface piece, the structure of the molding die can be simplified.

According to a certain aspect of the present invention, the abdominal belt includes a pair of side belt parts extending forward along an inner side of the pelvic frame from a rear part thereof and a front belt part connecting front ends of the side belt parts, and the walking assistance device further comprises a pair of stabilizer members each having a base end fixedly attached to the corresponding front portion of the pelvic frame and a free end engaging the corresponding side belt part of the abdominal belt, the free end of the stabilizer member permitting the side belt to move in a lengthwise direction relative to the stabilizer member.

The stabilizer member does not obstruct the wearing and removing of the abdominal belt because of the free movement of the abdominal belt in the lengthwise direction thereof relative to the stabilizer member while increasing the firmness in retaining the pelvic frame to the pelvic part of the wearer.

Preferably, each stabilizer member is flexible for a bending movement thereof toward and away from the user, and is stiff against a bending movement thereof in a vertical direction. Therefore, the wearing and removing of the abdominal belt is in no way hampered by the stabilizer member owing to the flexibility of the stabilizer member in the bending deformation toward and away from the user. On the other hand, owing to a high stiffness of the stabilizer member against a bending movement thereof in a vertical direction, the stabilizer member is highly effective in securing the pelvic frame to the pelvic part of the user in a stable manner. Also, this property of the stabilizer member prevents the front end part of the abdominal belt from drooping or sagging so that the handling of the abdominal belt when wearing and removing the pelvic frame on and from the pelvic part of the user is facilitated.

Such a property of the stabilizer member can be realized by an arrangement where each stabilizer member includes a main body including a plurality of fabric sheets layered and stitched together, a connecting member attached to a base end of the main body and fastened to the corresponding front portion of the pelvic frame and a belt holder attached to a free end of the main body and defining a slot through which the corresponding side belt part is passed.

BRIEF DESCRIPTION OF THE DRAWINGS

Now the present invention is described in the following with reference to the appended drawings, in which.

DETAILED DESCRIPTION OF THE PREFERRED EMBODIMENTS

An embodiment of a walking assistance device according to the present invention is described in the following with reference to FIGS. 1 to 3. In the following description, the directions of the walking assistance device will be generally based on the orientation as illustrated, and the fore and aft direction corresponds to the sagittal axis of the user while the lateral direction corresponds to the coronal axis of the user.

Figure 1:
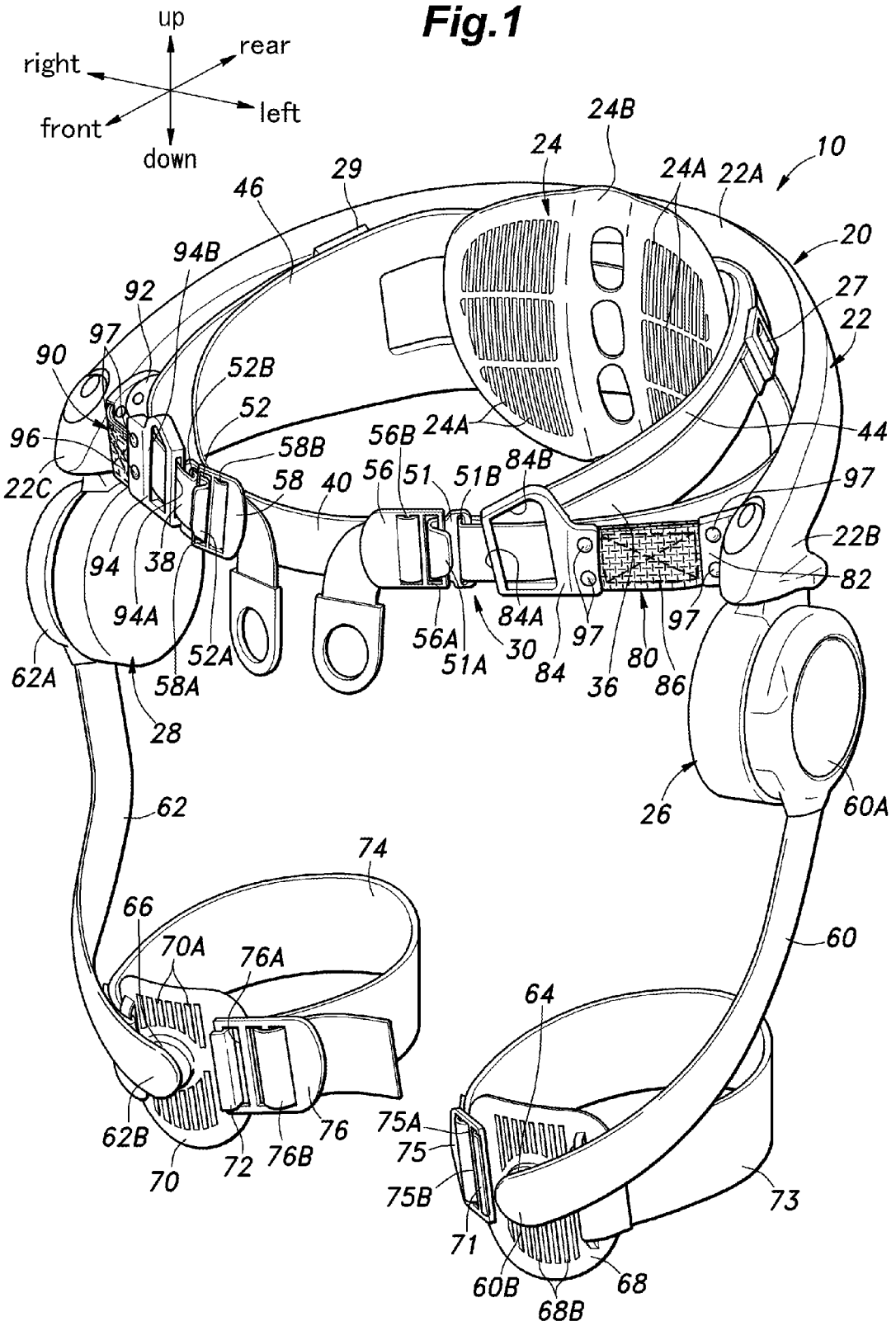
FIG. 1 is a perspective view of a walking assistance device embodying the present invention.
Figure 2:
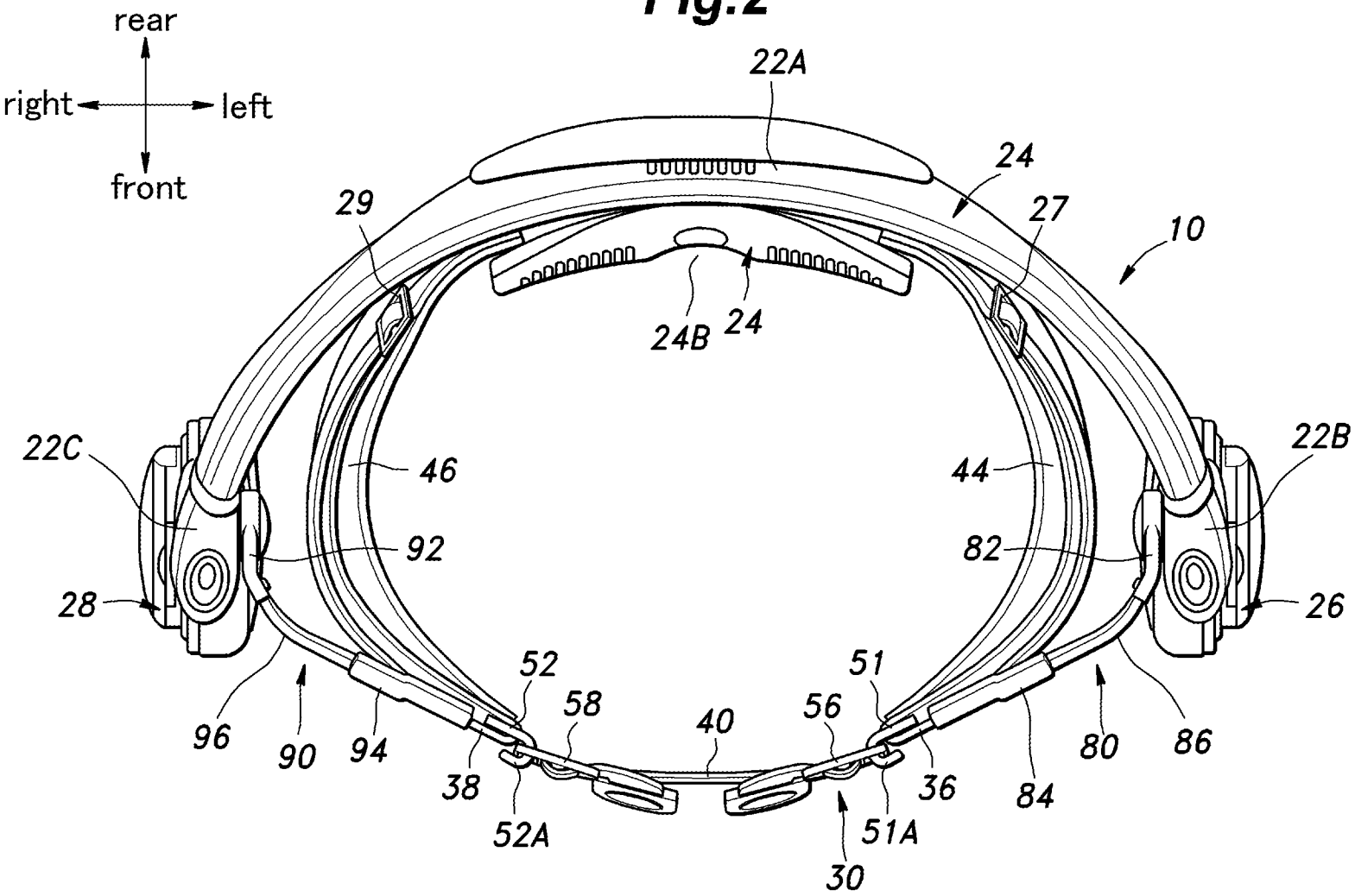
FIG. 2 is a plan view of the walking assistance device.

Referring to FIG. 1, the walking assistance device 10 according to the present invention comprises a pelvic support assembly 20 which is configured to be worn on a pelvic part of the user, and the pelvic support assembly 20 includes a pelvic frame (main frame) 22 having a substantially rigid structure. The pelvic frame 22 is generally C-shaped as seen in plan view, and includes an intermediate portion 22A configured to be applied to a lower back of the user and a pair of front portions 22B and 22C extending in a laterally outward and forward direction along an arcuate profile of either side of the hip or the pelvic part of the user. The pelvic frame 22 may consist of a hollow molded plastic member made of a high stiffness and high mechanical strength material such as glass fiber or carbon fiber reinforced plastic.

A back support plate 24 is provided on the side of the intermediate portion 22A of the pelvic frame 22 facing the user for comfortably supporting the lower back and/or the upper pelvic part of the user. The back support plate 24 is provided with a plurality of vertical slits 24A arranged laterally at a regular interval so as to acquire air breathability and flexibility, and a central recess 24B extending vertically to accommodate the lower vertebrae (backbone) and the coccyx (tailbone) of the user.

The intermediate portion 22A of the pelvic frame 22 is incorporated with a control unit and a battery pack in the hollow interior thereof although not shown in the drawings.

An abdominal belt 30 configured to be wrapped around the abdominal part of the user extends along the inner side of the pelvic frame 22. In the illustrated embodiment, the abdominal belt 30 includes a left side belt part 36, a right side belt part 38 and a front belt part 40. These belt parts 36, 38 and 40 may be made of flexible material such as fabric, leather and plastic.

One end of the left side belt part 36 is attached to an upper part of a left hand side of the intermediate portion 22A of the pelvic frame 22. The left side belt part 36 is passed through a slot 51B of a hook member 51, and is folded back to the intermediate portion 22A of the pelvic frame 22. The other end of the left side belt part 36 is attached to a lower part of the left hand side of the intermediate portion 22A of the pelvic frame 22. A buckle 27 is provided in an intermediate part of the left side belt part 36 to allow the length of the left side belt part 36 to be adjusted. The right side belt part 38 is similarly attached to the intermediate portion 22A of the pelvic frame 22, and passed through a slot 52B of a hook member 52. A buckle 29 is provided in an intermediate part of the right side belt part 38 to allow the length of the right side belt part 38 to be adjusted.

Each hook member 51, 52 has a width slightly greater than the width of the corresponding side belt part, and may be made of plastic or metallic material. Each hook member 51, 52 is provided with a hook 51A, 52A.

Each end of the front belt part 40 is fitted with a ladder shaped engagement member 56, 58. Each engagement member 56, 58 is provided with an opening 56A, 58A for engaging the corresponding hook 51A, 52A, and a bar 56B, 58B around which the corresponding end part of the front belt part 40 is passed so that the corresponding end part of the front belt part 40 is engaged by the engagement member 56, 58, and the length of the front belt part 40 may be adjusted. Each free end of the front belt part 40 is provided with a pull ring to facilitate the pulling of each free end of the front belt portion 40.

The pelvic support assembly 20 further comprises a left supporter piece 44 and a right supporter piece 46. Each supporter piece 44, 46 is made of relatively stiff sheet member having a vertical width greater than the combined width of the two runs of the corresponding side belt part 36, 38 extending along the outer surface of the supporter piece 44, 46. Each supporter piece 44, 46 has a base end located between the back support plate 24 and corresponding side belt part 36, 38, and is jointly secured to the pelvic frame 22, and extends along the inner surface of the side belt part 36, 38. To impart a suitable stiffness to each supporter piece 44, 46, a resilient plastic or metallic wire may be incorporated in the supporter piece 44, 46, for instance, along the outer periphery thereof.

Thus, the supporter pieces 44 and 46 are flexible enough to conform to the contour of the pelvic part of the user but stiff enough to distribute the pressure from the left and right side belt parts 36 and 38 over a large area of the body of the user so that the comfort of the user may be enhanced. Also, in order to increase the air breathability, and ensure adequate comfort to the user in a warm weather, the supporter pieces 44 and 46 may be at least partly made of a mesh type fabric or other air permeable material.

The base end of the left supporter piece 44 is secured to the intermediate portion 22A of the pelvic frame 22, and extends between the back support plate 24 and left side belt 36 as mentioned earlier. The free end of the left supporter piece 44 terminates at a point adjacent to the left hook member 51 in the illustrated embodiment, but may also extend slightly beyond the left hook member 51.

Similarly, the base end of the right supporter piece 46 is secured to the intermediate portion 22A of the pelvic frame 22, and extends between the back support plate 24 and right side belt part 38. The free end of the right supporter piece 46 terminates at a point adjacent to the right hook member 52 in the illustrated embodiment, but may also extend slightly beyond the left hook member 52. The right supporter piece 46 extends along the side of the user in a similar fashion as the left supporter piece 44.

Figure 3:
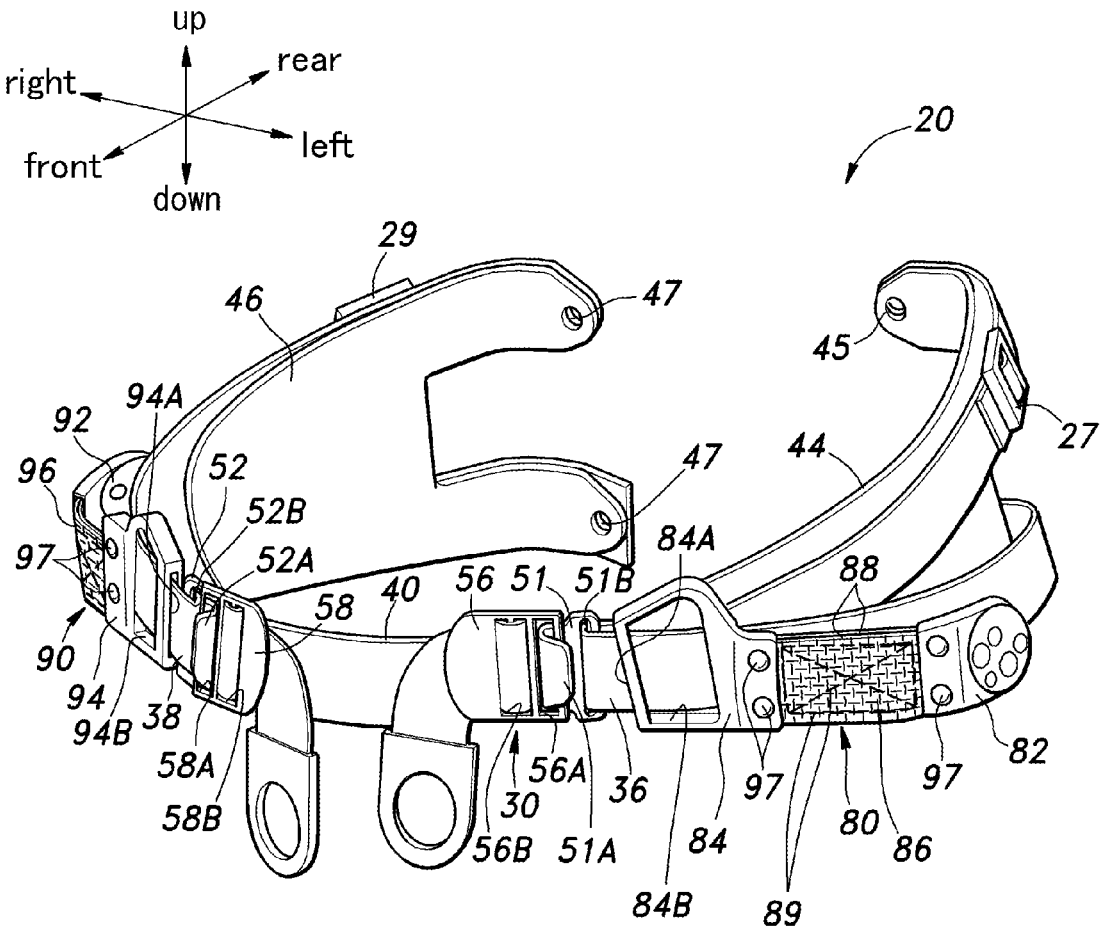
FIG. 3 is a perspective view of a pelvic support assembly of the walking assistance device.

FIG. 3 shows openings 45 and 47 formed in the base ends of the supporter pieces 44 and 46, and the side belt parts 36 and 38 to pass through rivets or other fasteners used for securing the base ends of the supporter pieces 44 and 46, and the side belt parts 36 and 38 to the pelvic frame 22.

A stabilizer member 80, 90 is attached to the inner side of each front portion 22B, 22C at a base end thereof by using screws, rivets or other fasteners. The free end of each stabilizer member 80, 90 is provided with a belt holder 84, 94 defining a slot 84 A, 94A through which the corresponding side belt part 36, 38 is passed. The slot of each belt holder 84, 94 permits the side belt part 36, 38 received therein to move freely in the lengthwise direction thereof, but prohibits the side belt part 36, 38 from moving in directions perpendicular to the lengthwise direction thereof. In particular, the stabilizer members 80 and 90 support the parts of the side belt parts 36 and 38 adjacent to the hook members 51 and 52 at which the side belt parts 36 and 38 are folded back.

Figure 4:
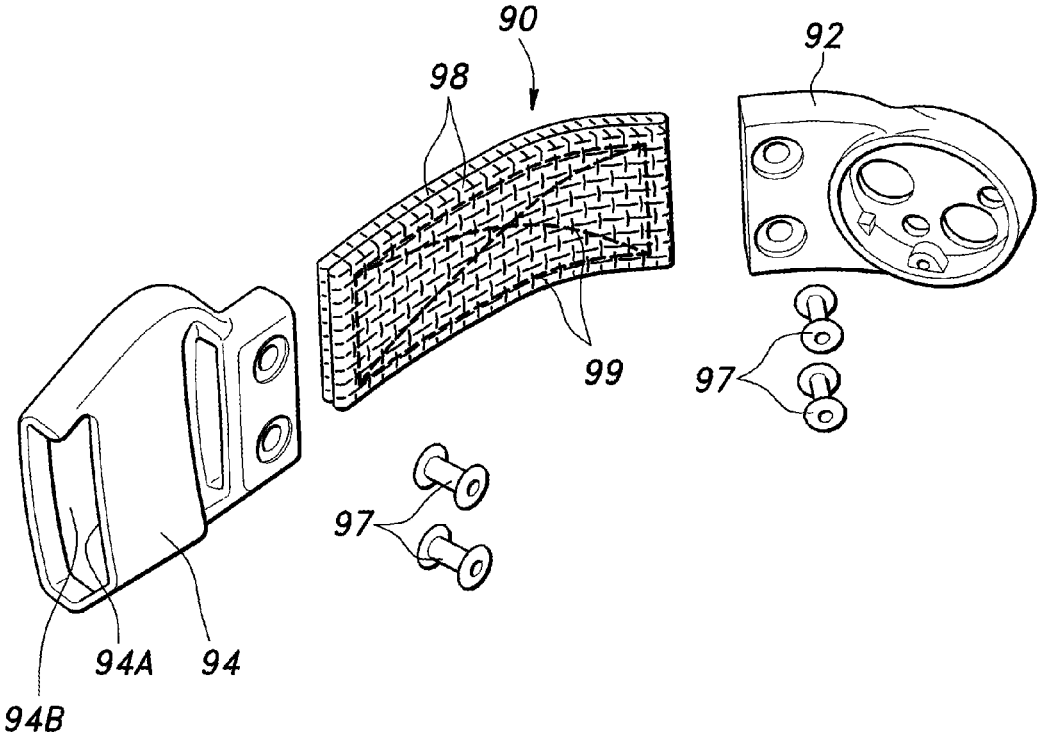
FIG. 4 is an exploded perspective view of a stabilizer member of the walking assistance device.
Figure 5:
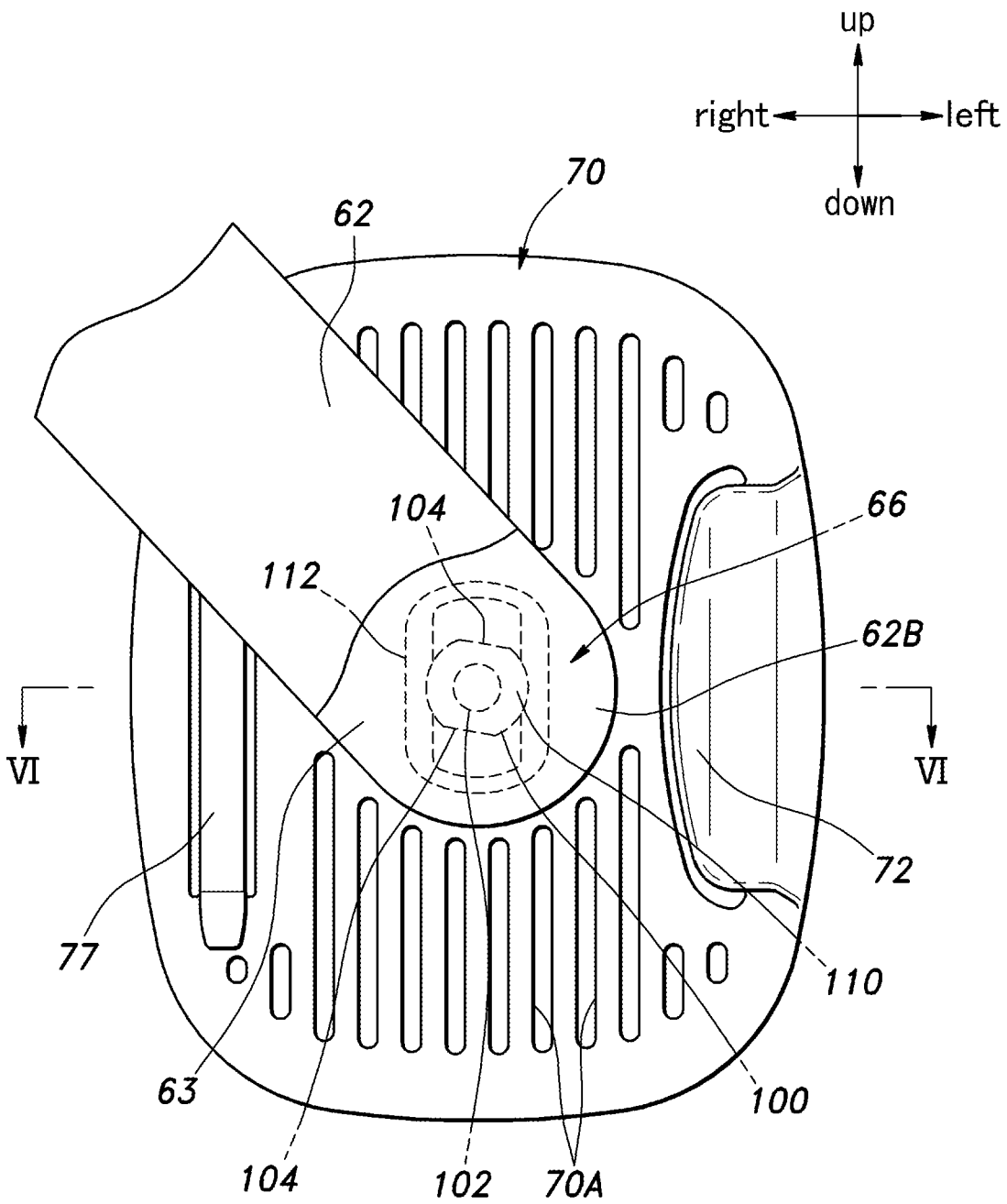
FIG. 5 is an enlarged front view of a femoral support plate of the walking assistance device.
Figure 6:
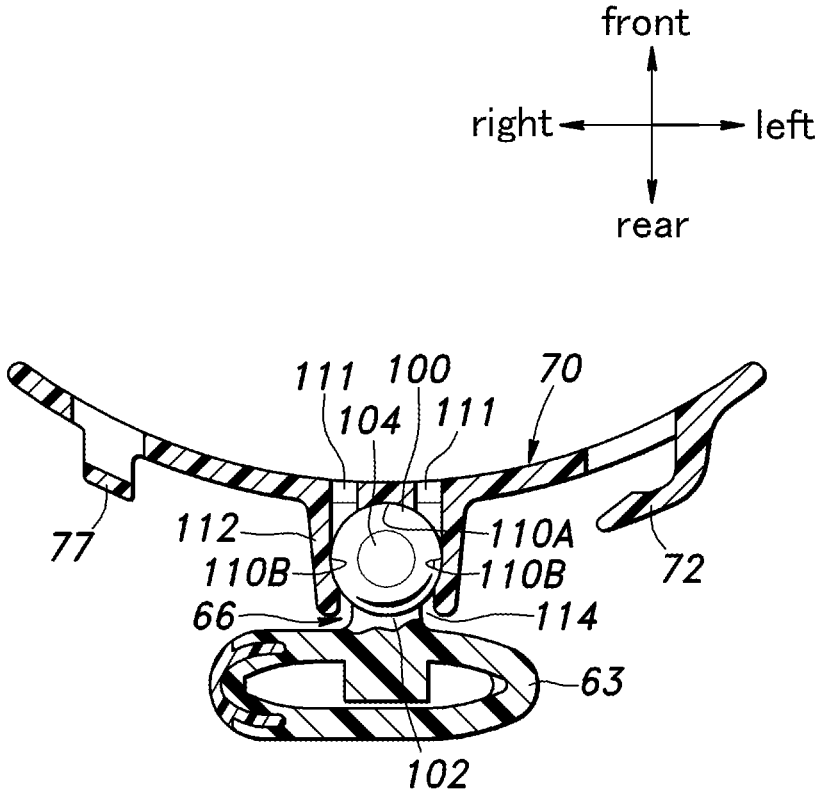
FIG. 6 is a sectional view taken along line VI-VI of FIG. 5.
Figure 7:
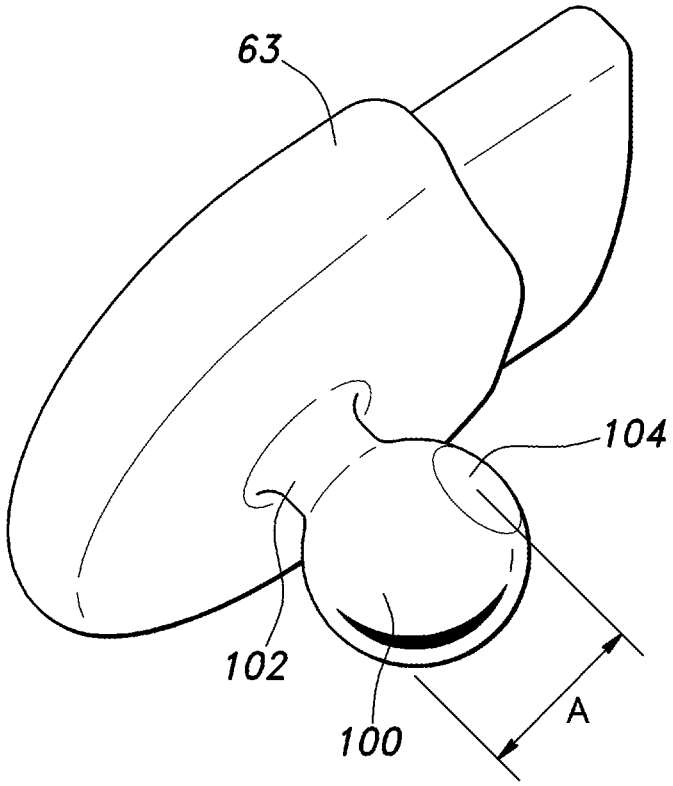
FIG. 7 is a fragmentary perspective view of a free end of a swing arm of the walking assistance device.

The left stabilizer member 80 includes a main body 86 having the shape of an elongated plate (belt) and a connecting member 82 connecting the base end of the main body 86 to the left front portion 22B. The belt holder 84 defining the slot 84A is attached to the free end of the main body 86. Likewise, the right stabilizer member 90 includes a main body 96 having the shape of an elongated plate (belt) and a connecting member 92 connecting the base end of the main body 86 to the right front portion 22C. The belt holder 94 defining the slot 94A is attached to the free end of the main body 86. In either case, the stabilizer member 80, 90 consists of three discrete components. FIG. 4 shows right stabilizer member 90.

The connecting members 82 and 92, and the belt holders 84 and 94 are made of highly rigid material such as polyamide resin or other hard plastic, and aluminum or other light weight alloy. Each belt holder 84, 94 is formed with an opening 84B, 94B on the front side thereof with the aim of minimizing the weight.

The main body 86, 96 is formed by stitching together a plurality (pair) of fabric sheets 88, 98. Numerals 89 and 99 denote the stitches. Each fabric sheet 88, 98 may consist of a plain woven fabric sheet made of polyester or other synthetic fibers or cotton or other natural fibers. Given with the shape of a belt, the main body 86, 96 demonstrates a high stiffness against a vertical bending deformation thereof, and a high flexibility in the fore and aft bending deformation thereof (away from and toward the user). In other words, the main body 86, 96 is able to readily conform to the contour of the user while being resistant to sagging in a released state. Therefore, the stabilizer members 80 and 90 freely permit the fastening and unfastening of the abdominal belt 30 toward and away from the user's abdominal part while preventing the drooping of the side belt parts 36 and 38 or retaining the hook members 51 and 52 at a prescribed height even when the abdominal belt 30 is unfastened. Also, the stabilizer members 80 and 90 secure the pelvic frame 22 to the pelvic part of the user such that the reaction force of motor units 26 and 28 (which will be described hereinafter) can be favorably supported by the pelvic part of the user via the pelvic frame 22.

The connection between the main body 86, 96 and the belt holder 84, 94 as well as the connection between the main body 86, 96 and the connecting member 82, 92 may be accomplished by rivets 97 or other fasteners that are preferably passed through the two parts that are to be connected.

The front portions 22B and 22C of the pelvic frame 22 are located on either side of the pelvic part of the user when the pelvic frame 22 is worn by the user as will be discussed hereinafter. A motor unit 26, 28 is connected to a lower end of each front portion 22B, 22C via a hinge having a hinge axis extending in the fore and aft direction although not shown in the drawings. Therefore, each motor unit 26, 28 is enabled to rotate around the sagittal axis (in the direction of spreading the leg) while being rigidly attached to the pelvic frame 22 in other respects. Each motor unit 26, 28 is incorporated with an electric motor and an angular sensor such as a rotary encoder for detecting the angular position of an output member of the electric motor.

A base end 60A, 62A of a swing arm 60, 62 can be detachably attached to each electric motor unit 26, 28 so that the output torque of the electric motor unit 26, 28 is converted into a fore and aft swinging movement of the swing arm 60, 62. The swing arm 60, 62 consists of an elongated plate member generally extending downward from the base end thereof adjacent to the hip joint of the user along a side of the femoral part of the user, and slightly twisted toward the lower end thereof so that the free end 60B, 62B thereof is located in front of the femoral part of the user, slightly above the knee of the user. Each swing arm 60, 62 may be made of a highly stiff but light material such as aluminum or other alloy, glass fiber or carbon fiber reinforced plastic material, A front femoral support plate 68, 70 is attached to the free end 60B, 62B of each swing arm 60, 62 via a spherical joint 64, 66. The front femoral support plate 68, 70 is made of a plastic plate member and curved so as to conform to the front face of the femoral part of the user, and is provided with a plurality of vertical slots 68A, 70A arranged laterally at a regular interval so as to acquire a breathability and a flexibility.

The laterally inner end of the front face of each front femoral support plate 68, 70 is integrally formed with a hook 71, 72. The laterally outer end of the front face of each front femoral support plate 68, 70 is provided with a vertical loop bar 77 for engaging a base end of a femoral belt 73, 74, and the free end of the femoral belt 73, 74 is fitted with a ladder shaped engagement member 75, 76 including a vertical bar 75B, 76B around which the free end of the femoral belt 73, 74 is passed so that the free end part of the femoral belt 73, 74 may be engaged and the effective length of the femoral belt 73, 74 may be adjusted, and a rectangular opening 75A, 76A configured to detachably engage the corresponding hook 71, 72. Thus, each femoral belt 73, 74 can be passed around the femoral part of the user in cooperation with the corresponding femoral support plate 68, 70 in a detachable and adjustable manner.

As described above, the walking assistance device 10 can be worn by the user by retaining the pelvic frame 22 on the pelvic part of the user with the abdominal belt 30, and securing the free end 60B, 62B of the swing arm 60, 62 on the front face of the femoral part of the user by using the front femoral support plate 68, 70 and the femoral belt 73, 74. The femoral belts 73 and 74 are then passed around the femoral parts of the user, and properly fastened to the front femoral support plates 68 and 70. As the user wearing the walking assistance device 10 moves the user's legs back and forth with an intent to walk, the electric motor units 26 and 28 provide a walking assistance force via the swing arms 60 and 62 that perform a back and forth swinging movement around the base ends 60A and 62A thereof.

In particular, the angular movements of the swing arms 60, 62 are detected by the angular sensors, and a control unit not shown in the drawings controls the electric motor units 26 and 28 such that the swing arms 60 and 62 are actuated in response to the walking movement of the user, and a walking assistance force is applied to the femoral parts of the user.

The details of the spherical joint 66 that connects the right swing arm 62 to the corresponding front femoral support plate 70 are discussed in the following with reference to FIGS. 5 to 11. The free end 62B of the right swing arm 62 is fitted with a tip member 63 made of injection molded hard plastic material. The tip member 63 includes a column 102 projecting therefrom toward the femoral part of the user and a ball 100 integrally formed in the tip of the column 102 in a coaxial manner. The ball 100 has a substantially large diameter than the column 102 so that the column 102 and the ball 100 jointly form a mushroom shaped extension (spherical projection). The ball 100 is provided with a pair of flat surfaces 104 on either side thereof in an approximately mutually parallel relationship with a slight taper toward the free end thereof. The flat surfaces 104 are located at substantially upper and lower parts of the ball 100 when the walking assistance device 10 is worn by the user.

The front femoral support plate 70 is integrally formed with a socket 112 defining a spherical recess 110 therein. The open end 114 of the spherical recess 110 is given with a vertically elongated rectangular shape. The lateral width B of the open end 114 of the spherical recess 110 defined by a pair of parallel edges is greater than the minimum value of the width A between the two flat surfaces 104 of the ball 100, and substantially equal to or slightly greater than the maximum value of the width A between the two flat surfaces 104 of the ball 100. The comparison of the dimensions here should be understood in a practical sense. Even when lateral width B may be slightly smaller than the width A between the two flat surfaces 104 of the ball 100, if the two flat surfaces 104 of the ball 100 can be forced into the opening defined by the parallel edges owing to the elastic deformation of the socket 112 and/or the ball 100, the lateral width B of the open end 114 of the spherical recess 110 should be considered as being equal to the maximum value of the width A between the two flat surfaces 104 of the ball 100 for practical purpose. The minimum value and the maximum value of the width A between the two flat surfaces 104 of the ball 100 are found in the tip end and the base end of the flat surfaces 104, respectively.

Figure 8:
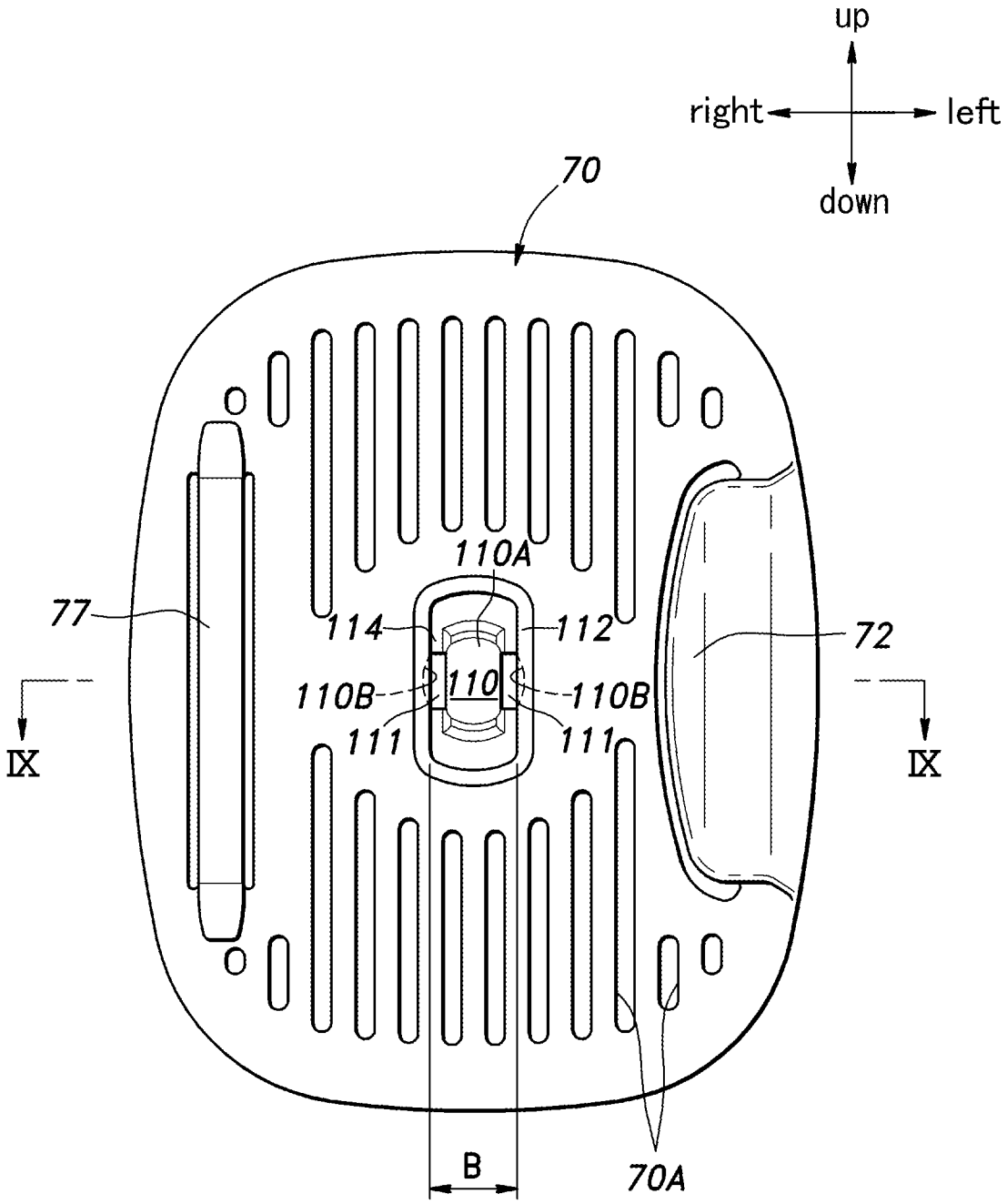
FIG. 8 is an enlarged front view of the femoral support plate revealing a socket thereof.
Figure 9:
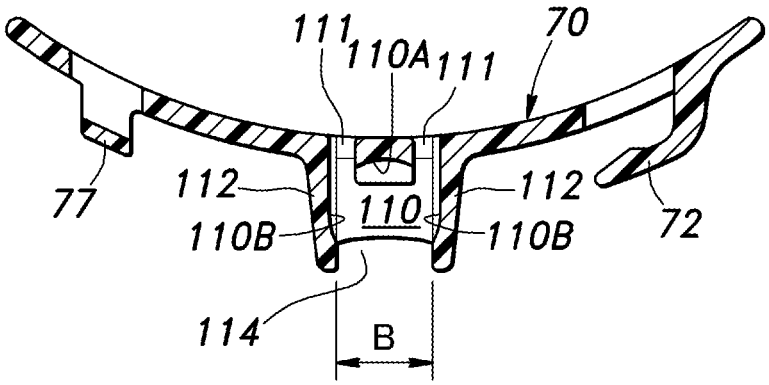
FIG. 9 is a sectional view taken along line IX-IX of FIG. 8.

The spherical recess 110 is not defined by a continuous spherical surface inside the open end 114, but by discrete surface pieces that include a bottom surface piece 110A located centrally opposite to the open end 114 and a pair of side surface pieces 110B located on either lateral side of the spherical recess 110, as best shown in FIGS. 8 and 9. The ball 100 is snugly received by these three surface pieces 110A and 110B so that the front femoral support plate 70 can be tilted in any desired direction with respect to the free end 62B of the right swing arm 62 preferably without any play.

More specifically, owing to the spherical joint 66, the front femoral support plate 70 is enabled to turn around the central axial line of the column 102, and tilt in any desired direction from the central axial line of the column 102. Therefore, the front femoral support plate 70 can accommodate the movement of the front part of the femoral part of the user, and can provide a favorable fit to the build of the user.

Figure 10A:
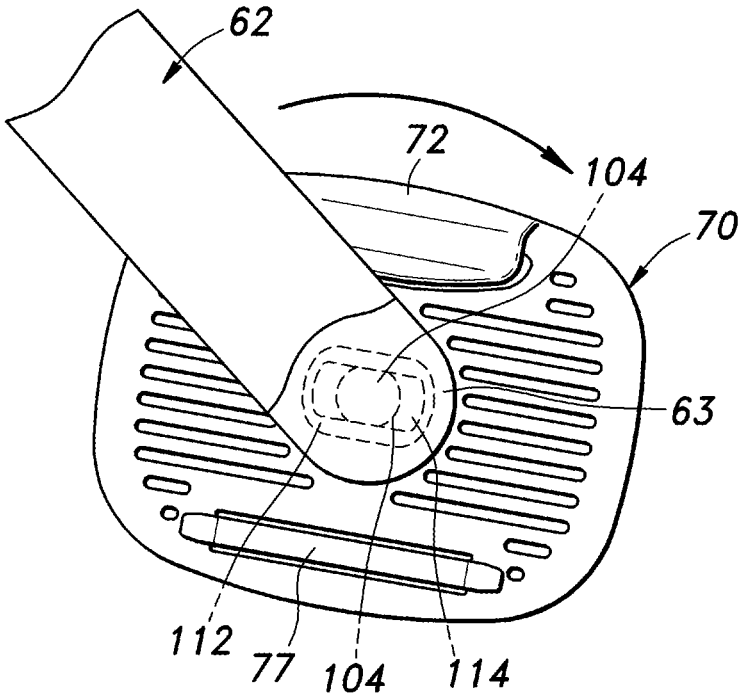
FIG. 10*a* is a view similar to FIG. 5 showing the orientation of the femoral support plate permitting the femoral support plate to be connected to (or disconnected from) the free end of the swing arm.
Figure 10B:
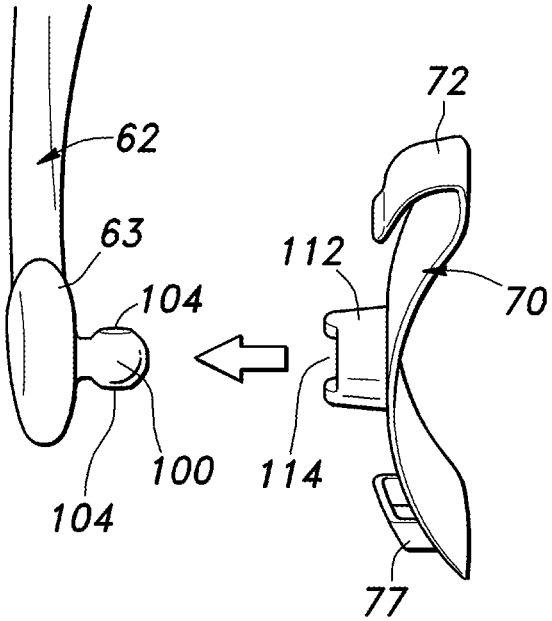
FIG. 10*b* is a perspective view showing a spherical projection being about to be fitted into a spherical recess of the socket.

The attachment of the front femoral support plate 70 to the free end 62B of the right swing arm 62 can be accomplished as described in the following. First of all, the front femoral support plate 70 is rotated around the central axial line of the column 102 by about 90 degrees from the normal orientation of the front femoral support plate 70 when in use, as shown in FIG. 10*a*. In this condition, the two flat surfaces 104 on the ball 100 align with the parallel edges of the open end 114 of the spherical recess 110 defining a narrower side so that the ball 100 can be fitted into the spherical recess 110 with a small force. If the width A between the base ends of the two flat surfaces 104 is greater than the width B between the parallel edges defining the narrower side of the open end 114, the socket 112 may be caused to resiliently deform by the pressure from the ball 100. This process is facilitated by the taper provided in the width between the two flat surfaces 104 of the ball 100.

Figure 11A:
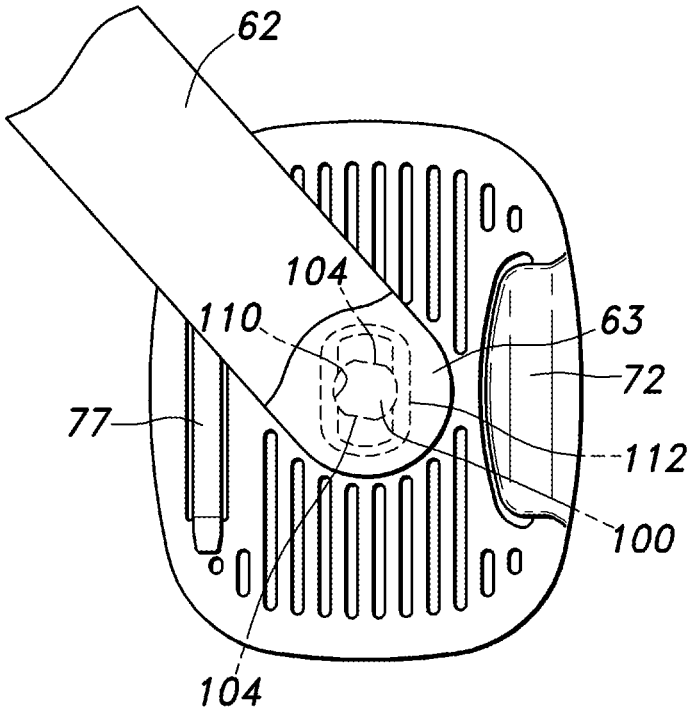
FIG. 11*a* is a view similar to FIG. 10*a* showing the orientation of the femoral support plate allowing the femoral support plate to be securely connected to the free end of the swing arm.
Figure 11B:
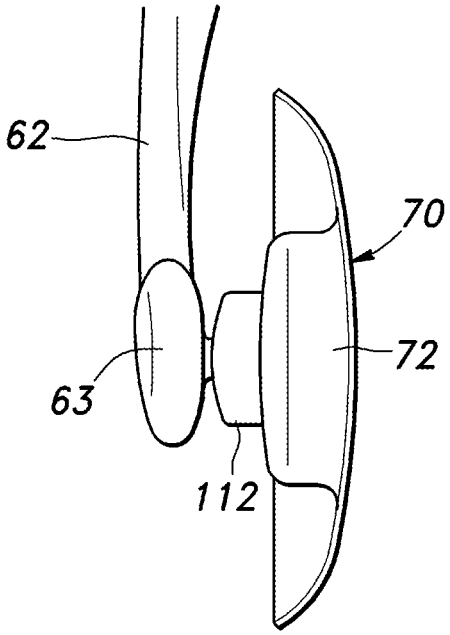
FIG. 11*b* is a view similar to FIG. 10*b* showing the spherical projection firmly retained in the spherical recess of the socket.
Figure 12:
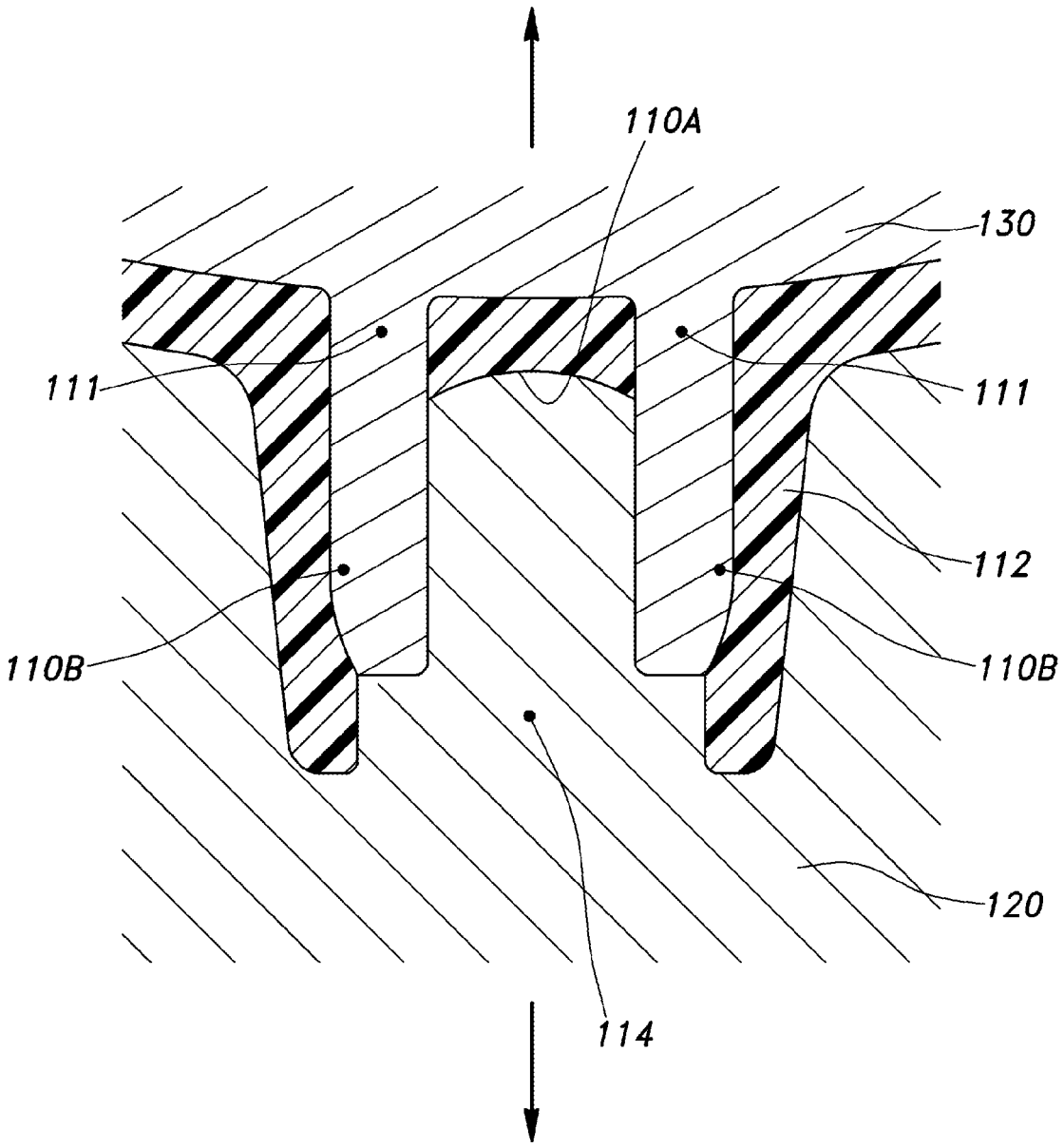
FIG. 12 is an enlarged sectional view showing a mold die for injection molding the femoral support plate.

Once the ball 100 is fully received in the spherical recess 110, the front femoral support plate 70 is rotated around the central axial line of the column 102 by about 90 degrees to the normal orientation of the front femoral support plate 70 when in use, as shown in FIG. 11*a*. As a result, the parallel edges defining the narrower side of the open end 114 of the spherical recess 110 are brought perpendicular to the two flat surfaces 104 so that the ball 100 is held within the spherical recess 110 because the nominal outer diameter of the ball 100 is greater than the width of the narrower side of the open end 114 of the spherical recess 110. The nominal outer diameter as used herein means the outer diameter of the ball 100 when the two flat surfaces 104 of the ball 100 are disregarded. At this time, the ball 100 is in sliding contact with the bottom surface piece 110A and the side surface pieces 110B jointly defining a spherical surface substantially without any play. As the side surface pieces 110B each include an overhang that engage an outer part of the ball 100, the front femoral support plate 70 is positively kept connected to the free end 62B of the right swing arm 62.

Therefore, the front femoral support plate 70 is prevented from being dislodged from the free end 62B of the right swing arm 62 in use, although the attachment and detachment of the front femoral support plate 70 to and from the free end 62B of the right swing arm 62 can be effected with ease. Because the front femoral support plate 70 is provided with a substantially part cylindrical form conforming to the front surface of the femoral part of the user, the rotation of the front femoral support plate 70 to the position that allows the detachment of the front femoral support plate 70 is highly improbable. The removal of the front femoral support plate 70 can be effected by reversing the procedure discussed above.

The fact that the side surface pieces 110B are more recessed outward than the outer ends thereof (defining the narrower side of the open end 114 of the spherical recess 110) may create a problem in the design of the mold die. To obviate this problem, a pair of rectangular through holes 111 are formed in the bottom part of the socket 112 on either side of the bottom surface piece 110A. Therefore, the socket 112 can be molded by a two piece molding die including a first part 120 for molding the outer profile of the socket 112 and the bottom surface piece 110A, and a second part 130 for molding the side surface pieces 110B. The two parts 120 and 130 can be separated away from each other when the molding process is completed.

The spherical joint 64 that connects the left swing arm 60 to the corresponding front femoral support plate 68 is a mirror image of the spherical joint 66 described above, and the detailed description thereof are omitted from this disclosure.

Although the present invention has been described in terms of preferred embodiments thereof, it is obvious to a person skilled in the art that various alterations and modifications are possible without departing from the scope of the present invention which is set forth in the appended claims. In particular, the various components included in the walking assistance device described above are not necessarily indispensable for the implementation of the present invention, and can be partly omitted and/or substituted without departing from the spirit of the present invention.

For instance, the structure of the spherical joints 64 and 66 can be reversed such that the ball 100 is provided on the front femoral support plate 68, 70, and the corresponding socket 112 is formed on the free end 60B, 62B of the right swing arm 60, 62 without departing from the spirit of the present invention.

The contents of the original Japanese patent applications on which the Paris Convention priority claim is made for the present application as well as those of references mentioned in this application are incorporated in this application by reference.

The invention claimed is:

1. A walking assistance device, comprising:

a pelvic frame having an intermediate portion configured to be applied to a lower back of a user and a pair of front portions extending laterally outward and forward from the intermediate portion;

an abdominal belt detachably securing the pelvic frame on a pelvic part of the user;

a power generator attached to each front portion of the pelvic frame at a position corresponding to a hip joint of the user;

a swing arm having a base end connected to an output end of each power generator; and a femoral support member connected to a free end of the swing arm via a pivot joint and configured to be applied to a femoral part of the user;

wherein the pivot joint includes a spherical projection provided on one of the free end of the swing arm and the femoral support member and a socket provided on the other of the free end of the swing arm and the femoral support member, the socket defining a spherical recess configured to receive the spherical projection to permit a tilting movement of the femoral support member at least in two directions with respect to the free end of the swing arm, and wherein the spherical projection is provided with a pair of flat surfaces on either side thereof substantially in parallel to each other, and the spherical recess is provided with an open end including a narrower side limited by a pair of parallel edges, a width between the two parallel edges being smaller than a nominal outer diameter of the spherical projection and being equal to or greater than a width between the two flat surfaces.

2. The walking assistance device according to claim 1, wherein the femoral support member includes a front femoral support plate configured to be applied to a front part of the femoral part of the user and a femoral belt configured to be detachably passed around the femoral part of the user and engaged by either side part of the femoral support plate at two ends thereof.

3. The walking assistance device according to claim 1, wherein the width between the two flat surfaces of the spherical projection is narrower at a free end of the spherical projection than at a base end thereof.

4. The walking assistance device according to claim 3, wherein the socket includes a plurality of discrete surface pieces defining an inner surface of the spherical recess, the discrete surface pieces including a bottom surface piece and a pair of side surface pieces, each side surface piece including an overhang such that the side surface pieces jointly define an open end of the spherical recess narrower than the nominal outer diameter of the spherical projection but equal to or wider than the width between the two flat surfaces of the spherical projection.

5. The walking assistance device according to claim 4, wherein the socket is provided with a pair of through holes on either side of the bottom surface piece.

6. The walking assistance device according to claim 1, wherein the abdominal belt includes a pair of side belt parts extending forward along an inner side of the pelvic frame from a rear part thereof and a front belt part connecting front ends of the side belt parts, and the walking assistance device further comprises a pair of stabilizer members each having a base end fixedly attached to the corresponding front portion of the pelvic frame and a free end engaging the corresponding side belt part of the abdominal belt, the free end of the stabilizer member permitting the side belt to move in a lengthwise direction relative to the stabilizer member.

7. The walking assistance device according to claim 6, wherein each stabilizer member is flexible for a bending movement thereof toward and away from the user, and is stiff against a bending movement thereof in a vertical direction.

8. The walking assistance device according to claim 6, wherein each stabilizer member includes a main body including a plurality of fabric sheets layered and stitched together, a connecting member attached to a base end of the main body and fastened to the corresponding front portion of the pelvic frame and a belt holder attached to a free end of the main body and defining a slot through which the corresponding side belt part is passed.

* * * * *